United States Patent [19]

Meeker

[11] Patent Number: 4,957,098

[45] Date of Patent: Sep. 18, 1990

[54] WALL SHIELD AND CHIMNEY SUPPORT

[76] Inventor: John G. Meeker, Rte. 6, Jeferson Valley, N.Y. 10535

[21] Appl. No.: 366,281

[22] Filed: Jun. 13, 1989

Related U.S. Application Data

[63] Continuation of Ser. No. 203,853, Jun. 7, 1988, abandoned.

[51] Int. Cl.[5] ..... F24B 7/00

[52] U.S. Cl. ..... 126/531; 126/67; 126/83; 126/307 R; 126/316

[58] Field of Search ..... 126/500, 509, 515, 518, 126/523–526, 528, 531, 529, 77, 312–316, 82, 83; 98/58, 60

[56] References Cited

U.S. PATENT DOCUMENTS

| | | | |
|---|---|---|---|
| 261,476 | 7/1882 | Neracher | 126/316 |
| 4,169,458 | 10/1979 | Shaw | 126/500 |
| 4,224,921 | 9/1980 | Petrescue | 126/288 |
| 4,287,871 | 9/1981 | Schumann | 126/67 |
| 4,519,376 | 5/1985 | Schoeff et al. | 126/531 |
| 4,607,611 | 8/1986 | Rice et al. | 126/531 |
| 4,700,687 | 10/1987 | Bailey et al. | 126/500 |

*Primary Examiner*—James C. Yeung
*Attorney, Agent, or Firm*—Pennie & Edmonds

[57] ABSTRACT

An improved fireplace unit adapted to fit flush within the wall of a dwelling is disclosed. The fireplace unit comprises duct means for ducting cooling air entirely around the inner wall of the unit and especially around the front lateral edges and top, whereby flammable building materials can be brought into close juxtaposition with the unit without substantial danger of fire. Plural ducts are provided for cooling the rear wall of the unit, having inlets at the bottom rear of the fireplace unit, extending upwardly along the rear wall of the unit, and forwardly around the chimney, further cooling this area. The top wall of the unit comprises an integral support member and thermal break which allows the unit to support a conventional chimney without further support structure and provides a substantial thermal break between the chimney and the front wall of the unit. In a preferred embodiment, the fireplace unit according to the invention accepts an inner fireplace member which can be readily removed for cleaning and maintenance as needed.

10 Claims, 3 Drawing Sheets

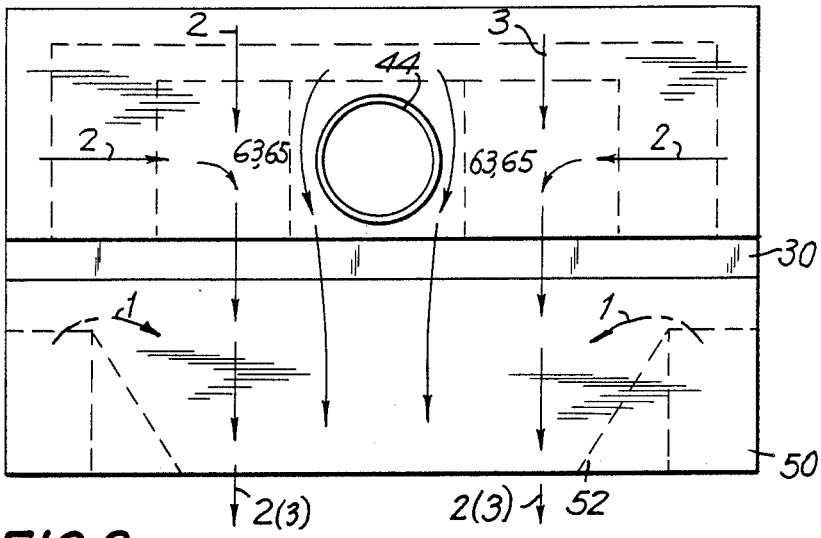
FIG. 2
FIG. 3
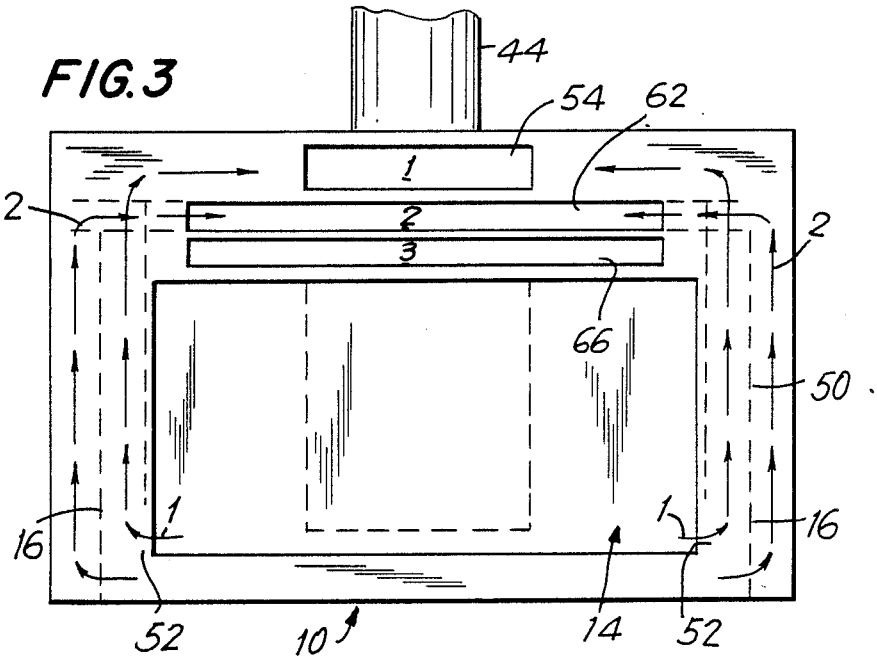

WALL SHIELD AND CHIMNEY SUPPORT

This is a continuation of application Ser. No. 203,853, filed June 7, 1988, abandoned.

FIELD OF THE INVENTION

This invention relates to an improved construction for a wall shield and chimney support, which in combination with an energy efficient combustion chamber comprises a prefabricated zero clearance fireplace.

BACKGROUND OF THE INVENTION

In recent years the rise in petroleum and other fossil fuel energy costs have led to resurgence in interest in burning wood as a primary source of heat for residential use. However, progress remains to be made in the area of prefabricated fireplaces for installation in homes. Specifically, the present inventor is aware of no prefabricated fireplace which can be directly contacted by the combustible materials commonly used in home construction, that is, wood and drywall, particularly around the face. Prior zero clearance designs require excessive house air to perform this cooling function.

SUMMARY OF THE INVENTION

Accordingly, it is an object of the invention to provide a fireplace structure for residential use which addresses and solves these problems exhibited by the fireplaces in the prior art. Specifically, it is an object of the invention to provide a fireplace which can be installed substantially flush with a surrounding wall, and in which the combustible materials of the wall can be brought directly up to the edge of the fireplace according to the invention, so that no non-combustible material need be interposed therebetween. It is a further object of the invention to provide an enclosure for a combustion chamber, the structure of which has sufficient structural integrity to support a relatively heavy chimney thereon.

These and other objects of the invention which will appear to those of skill in the art as the discussion below proceeds are fulfilled by the present invention which comprises a wall shield and chimney support (WSCS) unit. The WSCS unit comprises a metal box into which a fireplace insert can be inserted, such as the highly efficient wood kiln device shown in Applicant's prior Pat. No. 4,681,087. The WSCS unit comprises means for ducting cooling air substantially entirely around the interior surface of the box, between it and the fireplace insert, preventing the wall from reaching the combustion temperatures of common house construction materials. Accordingly, these construction materials can be brought into direct contact with the outer surface of the WSCS unit. The top of the WSCS unit further comprises a support beam which is sufficiently strong to support the weight of a chimney thereon, further simplifying construction of a house using the WSCS unit.

More specifically, the WSCS unit comprises means for ducting cooling air around a fuel-receiving opening in the front of the unit. This ducting comprises inlets at the lower corners of the fuel-receiving opening, which then run vertically upwardly and then inwardly across the top front of the WSCS unit to cool it, exiting out the front of the unit. Additional ducting is provided to thermally shield the sides and the back wall of the unit, via further air ducts also exiting through its front. The result is that the inner surface of the WSCS unit is entirely cooled by convection of air.

The top surface of the box is formed to integrally comprise a "U"-shaped thermal break and chimney support member extending transversely across the top of the unit. This provides sufficient strength to support the weight of a normal chimney.

BRIEF DESCRIPTION OF THE DRAWINGS

The invention will be better understood if reference is made to the accompanying drawings, in which:

FIG. 2 shows a top view of the unit of the invention, showing air flow therein;

FIG. 3 shows a front elevational view of the unit of the invention, also showing air flow therein.

DESCRIPTION OF THE PREFERRED EMBODIMENTS

As described above, a principal object of the invention is to provide a fireplace unit which can be installed with conventional flammable building materials contacting its front surfaces, so that the front of the fireplace unit can be flush to and in contact with the materials of the surrounding wall. A second object of the invention is to provide a prefabricated fireplace unit that is sufficiently strong to bear the weight of a chimney, such that no separate structural provision need be made therefor. The WSCS unit 10 of the invention achieves these objects.

Figure 4:
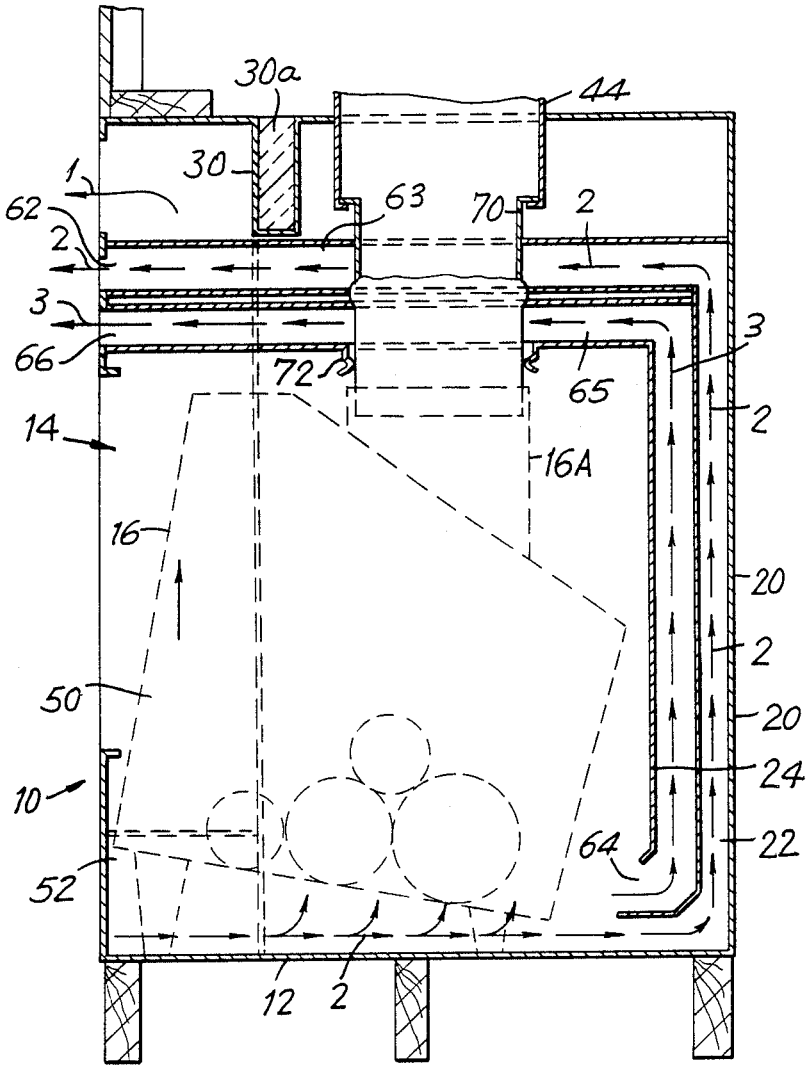
FIG. 4 shows a left side cross-sectional view of the unit of the invention, also showing air flow therein, and illustrating the manner in which a fireplace insert can be disposed therein.

As illustrated in the drawings, the WSCS unit 10 comprises a generally rectangular box having an outer shell 12. The outer shell 12 defines a fuel-receiving front opening 14 through which a fireplace insert, such as the wood kiln shown in Applicant's U.S. Pat. No. 4,681,087, can be inserted as shown in dotted line at 16 in FIG. 4. As indicated in FIG. 4, the fireplace insert 16 comprises a chimney portion 16A which communicates with the chimney 44 of the unit according to the invention for carrying wood smoke therefrom into the conventional chimney structure of the home.

As described above, according to the invention, substantial quantities of air are caused by convection to flow entirely around the inner surface of the box. This allows flammable building materials to be closely juxtaposed to the box 12. Three separate air flow paths are indicated by the circled reference numerals 1–3. In particular, flammable materials can be juxtaposed flush to the edges of the front of the box as indicated in FIG. 4.

Figure 1:
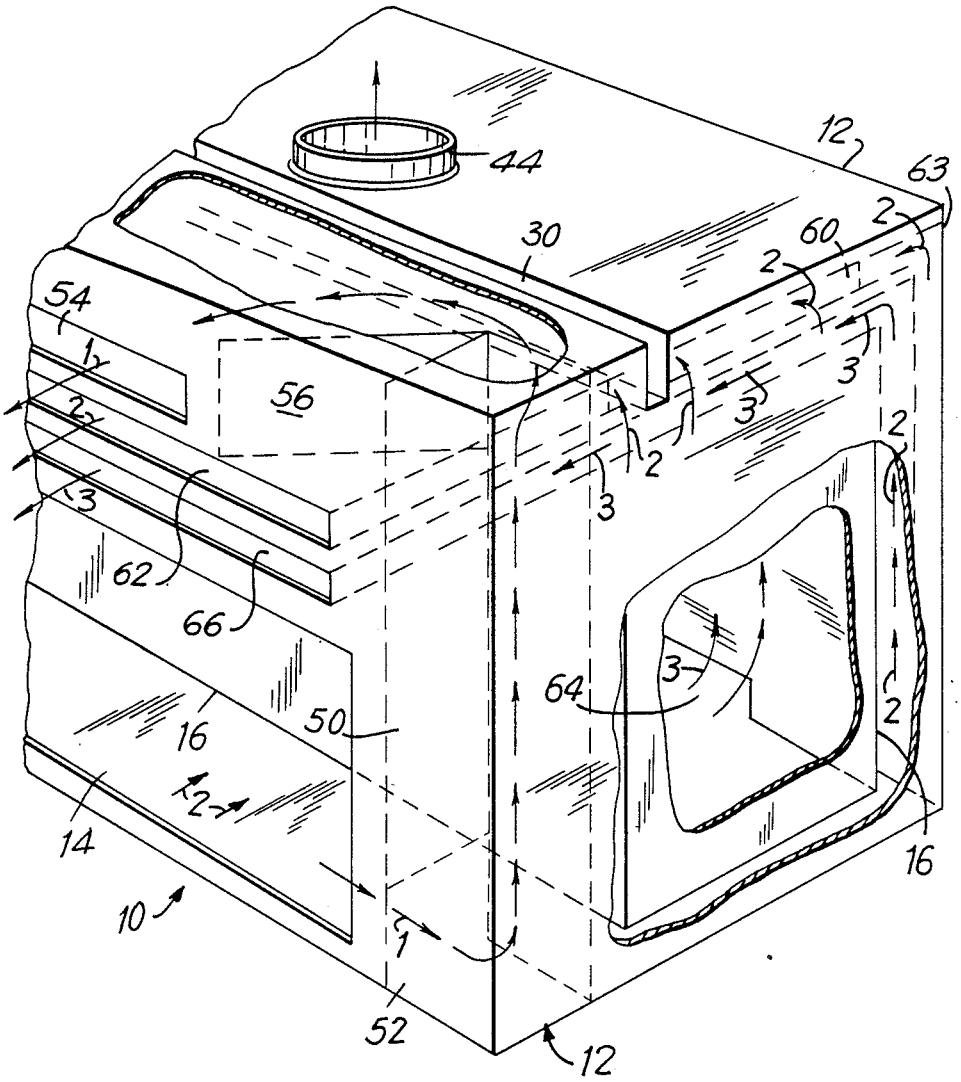
FIG. 1 shows a partially cut-away perspective view of the right half of the WSCS unit according to the invention, with arrows illustrating air flow therein.

As shown in FIG. 1, the top of the WSCS unit has formed integrally therein a U-shaped channel 30, which serves to support a chimney and also serves as a thermal break. The channel 30 and the remainder of the outer surface of the box are made of sheet metal, typically 16 gauge mild steel for the outer box and structural members such as the U-beam 30. 24 gauge mild steel can be used for internal ducting and other non-structural members. Chimney members which are in direct contact with wood smoke from the fire may be formed of 24 gauge type 430 stainless steel.

A first air flow path 1 extends through vertical ducts 50 disposed on either side of the front fuel-receiving opening 14. Openings 52 provide entry of cooling air in ducts 50 on either side of the bottom of the fuel-receiving opening 14 in the front of the housing 12. The air flow path 1 extends upwardly as indicated by the arrows and then at the top of the box turns inwardly towards the center front of the box, and exits through an opening 54 formed therein. Internal baffles 56 are provided as shown in FIGS. 1 and 2 to ensure that the air flow 1 closely approaches the center of the top of the box, which is typically the hottest part of a fireplace, to ensure that this area is adequately cooled.

As indicated, a transverse U-shaped member 30 is formed in the top of the box 12. Member 30 provides substantial strength to the box so that it can support a chimney. Member 30 also forms the rear of ducts 50 through which air flow path 1 extends. Furthermore, according to the invention, U-shaped member 50 provides a thermal break between the area around the top of the box at which the chimney 44 exits the box 12, which is normally quite hot, and the front surface of box 12, which is in contact with flammable building materials. The U-shaped member 30 may have insulation placed therein as indicated at 30*a*.

Thus, according to an important aspect of the invention, U-shaped member 30 provides several distinct functions in a highly efficient fashion. It is a thermal break which insulates the chimney 44 from the front of the top of the box 12, such that flammable building materials can be juxtaposed thereto. As also noted, the thermal break 30 is U-shaped and is formed of relatively heavy sheet metal; this provides sufficient beam strength that the WSCS box 12 according to the invention can support the weight of a metal chimney thereon. This fact is of substantial importance, in that it simplifies the construction of a house constructed employing the inventive WSCS unit, because no additional support need then be provided for the chimney.

Air flow paths 2 and 3 are also shown in the drawings, and cool the sides, bottom and rear wall of the box. Air flow paths 2 and 3 are defined by internal duct members. In effect, air flow path 2 extends between the walls of the box and side, back and top walls of an inner box, while air flow path 3 extends between this inner box and third innermost rear and top wall members.

More specifically, and as indicated in FIG. 4, air flow path 2 extends along the bottom of the box, beneath the fireplace insert 16, upwardly along the side walls of the box, back to the rear corners as indicated in FIGS. 1, 3 and 4, and also up along the outer back wall of the box 12. Air flowing along path 2 up the side walls enters a duct 63, which fits just under the thermal break 30 as illustrated in FIG. 4, through openings 60 which extend laterally outwardly, that is, towards the right and left sides of the box. Air flow path 2 exits duct 63 through an opening 62 in the front of the box 12. Air flow path 2 thus cools the bottom, sides, and rear of the box.

The third air flow path 3 begins in an opening 64 in the bottom rear of the box, as indicated in FIGS. 1 and 4, and extends upwardly along the rear of the box as indicated in FIG. 4, between an innermost rear wall 24 and a central rear wall 22 separating air flow paths 2 and 3. Air flow path 3 then enters a duct 65 beneath duct 63, and exits the front of the box at an opening 66 as indicated in FIGS. 1 and 4. As can be seen from FIG. 2, the ducts 63 and 65, by which air flow paths 2 and 3 extend from the rear top of the box to their exits at openings 62, 66, respectively, each pass around the chimney 44 where it passes through the top of the box 12, thus further cooling this critical area.

The fireplace insert 16 is made removable from the box 12 for cleaning and maintenance purposes. Preferably, a section of the chimney 44 indicated schematically at 70 is a slip fit over the chimney portion 16A of the fireplace insert such that it can be slid upwardly to allow ready removal of the fireplace insert 16. Clips 72 illustrated in FIG. 4 may be provided to hold the slip fit section 70 in place during such operations.

As indicated schematically in FIG. 4, the fireplace unit 10 according to the invention may be directly juxtaposed to wood and other flammable materials due to the unique nature of its construction which provides a flow of insulative air all the way around its inner surface.

While a preferred embodiment of the invention has been disclosed, the invention is not to be limited thereby, but only by the following claims.

What is claimed is:

1. A wall shield and chimney support unit for insertion into a wall comprising flammable materials, comprising:

an outermost metal box comprising a front wall, a rear wall, side walls, and top and bottom walls, an opening being formed in the front wall of said box, a chimney duct member extending from the top wall of the box and adapted to mate with an associated chimney in an associated dwelling, support means formed integrally with the top of said box for supporting the weight of the associated chimney, and air ducting means for ducting air in plural different air flow paths from inlets near the bottom front of the box up the front lateral corners of the box, thence laterally inwardly and exiting through at least one exit opening generally in the front surface of the box, whereby flammable building materials may be brought in close juxtaposition to the periphery of the front of said box.

2. The unit of claim 1, further comprising air ducting means for defining an air flow path along the left and right side walls of the box, an air flow path along the rear wall of the box, and an air flow path along the top of the box, whereby the combination of said air flow paths cools substantially all of the inner surfaces of said box.

3. The unit of claim 2, wherein said support means formed integrally with the top wall of said box is a generally U-shaped channel member extending transversely across the top of said box.

4. The unit of claim 3 wherein said air flow path extending up the front corners of said box is defined such that said air flow path reaches substantially the top center of said box, whereby the vicinity of said chimney is cooled, and wherein said U-shaped channel member additionally comprises a thermal break to further insulate the portion of the top wall of said box surrounding said chimney from the top front of said box.

5. The unit of claim 1 wherein the rear wall of said box comprises dual ducting means whereby first and second vertical air flow paths are provided to cool the rear wall of said box.

6. The unit of claim 1 wherein plural duct means are provided for providing plural air flow paths from the rear top of said box around said chimney duct member extending through the top wall of said box and exiting the front of said box, whereby substantial air flow cooling the vicinity of said chimney duct member is provided.

7. The unit of claim 1 wherein said air flow paths extending up the front lateral corners of the box then extend laterally inwardly towards the top center of said box and exit through an opening in the front of said box.

8. The fireplace unit of claim 1 wherein the opening in the front wall of said box is adapted to receive a conventional fireplace insert, and said chimney duct member is adapted to mate with chimney means comprised by such a conventional fireplace insert.

9. The fireplace unit of claim 8 wherein said chimney duct member comprises a slip fit section adapted to slip over the chimney means of the fireplace insert.

10. The unit of claim 9 further comprising clip means adapted to retain said slip fit section in a desired position during removal and reassembly of said fireplace insert from said fireplace unit.

* * * * *